US006876268B2

(12) United States Patent
Walter et al.

(10) Patent No.: US 6,876,268 B2
(45) Date of Patent: Apr. 5, 2005

(54) CAPACITIVE FINGER COUPLING ELEMENT ON A SILICON SUPPORT FOR COUPLING A STRIP LINE STRUCTURE

(75) Inventors: Thomas Walter, Renningen (DE); Markus Ulm, Sersheim (DE); Stefan Keith, Leonberg (DE); Dirk Steinbuch, Wimsheim (DE); Mathias Reimann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/381,236

(22) PCT Filed: May 7, 2002

(86) PCT No.: PCT/DE02/01639

§ 371 (c)(1),
(2), (4) Date: Sep. 8, 2003

(87) PCT Pub. No.: WO03/012914

PCT Pub. Date: Feb. 13, 2003

(65) Prior Publication Data

US 2004/0036549 A1 Feb. 26, 2004

(30) Foreign Application Priority Data

Jul. 20, 2001 (DE) ..... 101 34 685

(51) Int. Cl.[7] ..... H01P 5/02

(52) U.S. Cl. ..... 333/24 C; 333/246

(58) Field of Search ..... 333/24 C, 246, 333/245, 204, 116

(56) References Cited

U.S. PATENT DOCUMENTS

| | | | | | |
|---|---|---|---|---|---|
| 4,800,343 A | * | 1/1989 | Kinoshita | ..... | 333/24 C |
| 5,216,395 A | * | 6/1993 | Babbitt et al. | ..... | 333/246 |

FOREIGN PATENT DOCUMENTS

| | | | | | |
|---|---|---|---|---|---|
| EP | 0 963 001 | | 12/1999 | | |
| JP | 95601 | * | 4/1989 | ..... | 333/246 |
| JP | 6216613 | * | 8/1994 | ..... | 333/116 |

* cited by examiner

*Primary Examiner*—Benny Lee
(74) *Attorney, Agent, or Firm*—Kenyon & Kenyon

(57) ABSTRACT

A coupling element for an HF strip line structure on an HF substrate, implemented in thin-layer technology as a finger coupler structure on a silicon support is described. The bonding to the strip line tracks of the HF strip line structure is effected via metallizations, in particular in the form of spacers.

10 Claims, 3 Drawing Sheets

CAPACITIVE FINGER COUPLING ELEMENT ON A SILICON SUPPORT FOR COUPLING A STRIP LINE STRUCTURE

FIELD OF THE INVENTION

The present invention relates to a coupling element for an HF strip line structure on an HF substrate.

BACKGROUND INFORMATION

Finger couplers or DC blocks are utilized for the direct voltage decoupling of components in HF technology, in particular in radar technology. These elements are part of the strip line circuit and are thus etched as a structure. The HF signal passes through a bandpass characteristic due to the overlapping fingers; the direct voltage, however, is blocked. This bandpass characteristic is essential for the function of the radar, since it prevents low-frequency portions of the control pulse from being relayed. Therefore, a single series capacitance is not sufficient.

The finger width of a coupler is a function of the substrate and the conductor impedance. The common conductor impedance is a standard 50 Ohm and is determined by the conductor width. Considering the given parameters, one would arrive at a finger width of 90 $\mu$m and a gap of 60 $\mu$m. These dimensions cannot be implemented in a large-scale production process. In order to nevertheless implement this coupler, as FIG. 2 shows, upstream and downstream of coupler 1, a line transformation 2 to a lower, complex impedance is performed, which has the effect that the finger width increases to 200 $\mu$m and the gap increases to 120 $\mu$m which makes them suitable for manufacturing, as FIG. 2 shows.

SUMMARY OF THE INVENTION

The measures according to the present invention make it possible to implement a coupling element for a strip line structure on an HF substrate, which has direct-voltage decoupling requiring little space and having a sufficient broadband capacity for HF signals, i.e., a required bandpass characteristic.

In the present invention, by using a discrete component on a silicon support, an etched finger coupler structure is implemented on the HF substrate and bonded to the strip line tracks of the HF strip line structure via metallizations.

In contrast to the aforementioned coupling element, no line transformations which disadvantageously influence the bandwidth are necessary in the coupling element according to the present invention. Line transformations render the coupling element more narrow-band and a tendency to oscillation exists, in particular when HF switches are in the proximity topologically. Since this is the case in particular in radar applications, the present invention is particularly advantageous for this type of application in order to effectively lessen the interference mentioned above.

The design approach according to the present invention requires only a negligible additional expense and may be designed to be advantageously compatible with pick and place technologies which are provided for other HF components on the strip line structure anyway.

According to the present invention, the measures of the present invention make a meander-shape design of the finger coupler structure possible.

According to the present invention, bonding of the metallizations to the strip line tracks is advantageously implemented by using spacers which ensure a predefined air gap between the silicon support and the HF substrate. This design allows the creation of more exactly processable relationships which may also be considered in dimensioning the finger coupler structure.

DETAILED DESCRIPTION OF THE INVENTION

Figure 1:
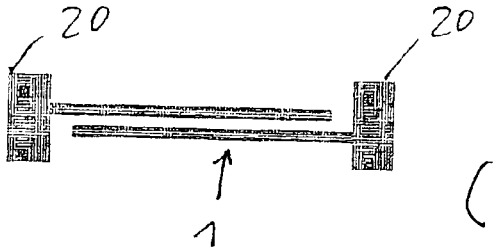
Fig. 1 (Prior Art)
FIG. 1 shows a known coupling element for an HF strip line structure.
Figure 2:
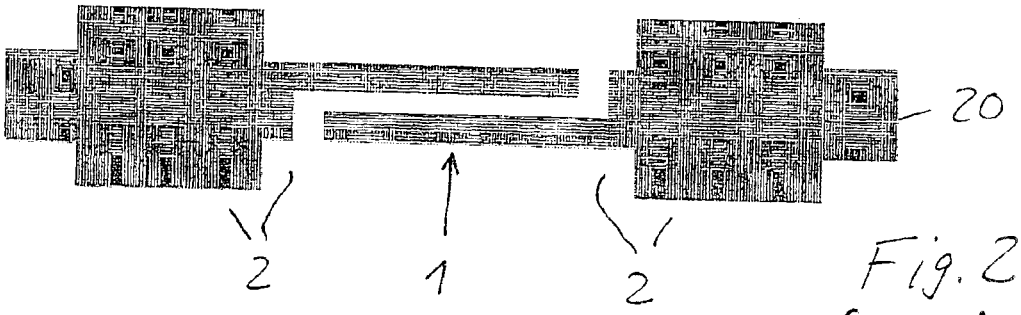
Fig. 2 (Prior Art)
FIG. 2 shows a known coupling element for an HF strip line structure including line transformation.
Figure 3:
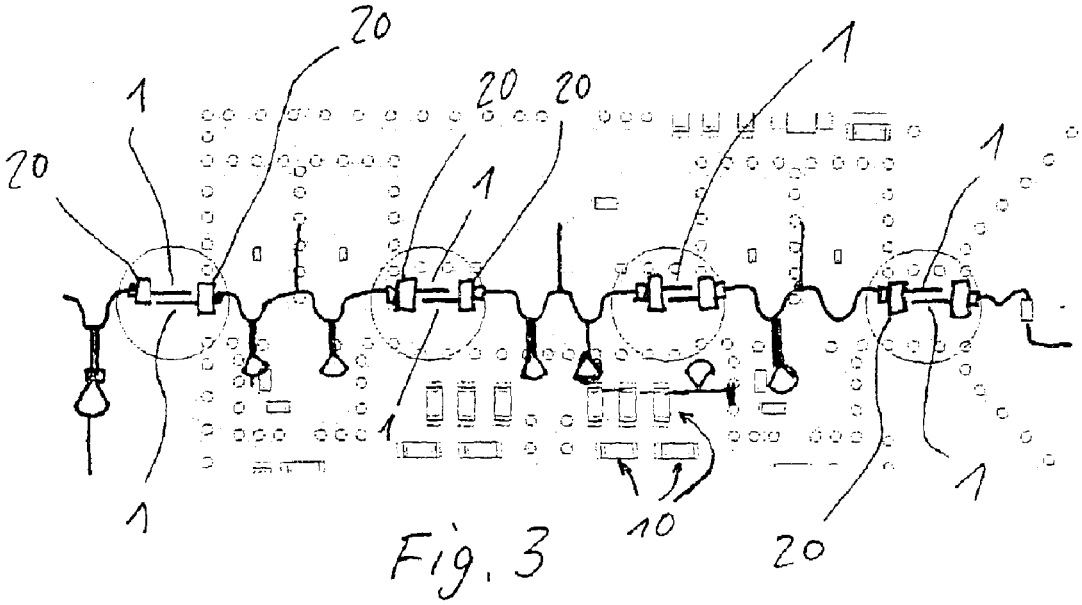
FIG. 3 shows the layout of an HF strip line structure having an integrated finger coupler structure.

The known coupling element illustrated in FIG. 1 has a finger coupler structure 1 including two overlapping strip lines in finger form running parallel to each other, each ending in pads 20. The coupling is essentially capacitive here. The overlapping fingers ensure a band characteristic for high-frequency signals; however, direct components and low-frequency components are blocked. The length of such a coupling element is 2.75 mm, having a pad width of 0.638 mm. FIG. 3 in a cutaway view, shows the layout of such a finger coupler structure 1 within an HF strip line structure, pads 20 and additional components 10. A line transformation is necessary for implementing such a coupling element in a large-scale manufacturing process, as pointed out initially. FIG. 2 shows such a structure including line transformations 2. The overall length thus increases to 6.15 mm.

Figure 5:
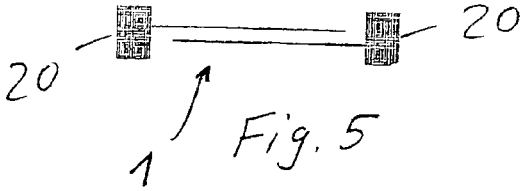
FIG. 5 shows a coupling element according to the present invention in top view.
Figure 4:
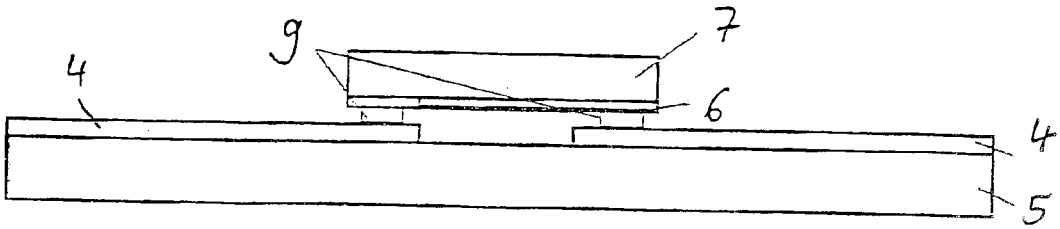
FIG. 4 shows a section through a coupling element according to the present invention.

According to FIGS. 4 and 5, a strip line structure 4 (See FIG. 4) is applied to a common HF substrate 5 (See FIG. 4) in the coupling element according to the present invention. Finger coupler structure 1 (See FIG. 5) per se, which ensures the bandpass characteristic for HF signals, is implemented on an HF-capable silicon support 7 as a thin-layer structure 6 in the form of a discrete component as shown in FIG. 4. Because of the higher dielectric constant of silicon, the gap width is now, for example, 50 $\mu$m and the finger thickness 20 $\mu$m. Conductor dimensions and gap dimensions of a magnitude from 1 $\mu$m to 2 $\mu$m are implementable due to the thin-layer processes used in silicon wafers. The strip line tracks of HF strip line structure 4 are bonded to finger coupler structure 1 via metallizations which are provided in the form of spacers 9 (See FIG. 4), i.e., bumps, between planar pads 20 (See FIG. 5) of the component and strip lines 4. These spacers 9 are glued onto the strip line track, setting a defined spacing of the discrete component including finger coupler structure 1 to HF substrate 5. This is important, since the dimensions of the fingers are no longer dependent on the HF substrate and the line impedance alone, but also on the properties of the silicon and the air gap between HF substrate 5 and the component. These dimensions and data must be taken into account during development. The height of the air gap proves to be critical here. It is reproducibly set by the spacers.

By virtue of the fact that the effective dielectric constant is increased by factor 2.2 due to the highly dielectric silicon supports, the finger length is shortened by the square root of this amount, thereby already saving space. Furthermore, additional 2.6 mm are saved due to the omission of the line transformations, since the system remains in the 50 Ohm system and impedance transformations are not necessary. In effect, the coupler is thus reduced from 6.15 mm to 2 mm (FIG. 5).

Since the conductor width on the HF substrate is now 0.64 mm, this width may be completely available to the component. The component was thus broadened to 0.6 mm and the finger structure was laid out as a meander form. This procedure resulted in a further reduction in length, which is thus only 1 mm with a pad width of 0.4 mm (FIG. 6).

The simple design of the coupling element, composed only of support 7 and two simple metallizations (structure 6 and bumps 9), may be implemented in an extremely cost-effective way using a simple semiconductor process. These components are drawn onto a reel and may be automatically installed using regular machines which are required in any event for the fitting with additional components 10.

Figure 6:
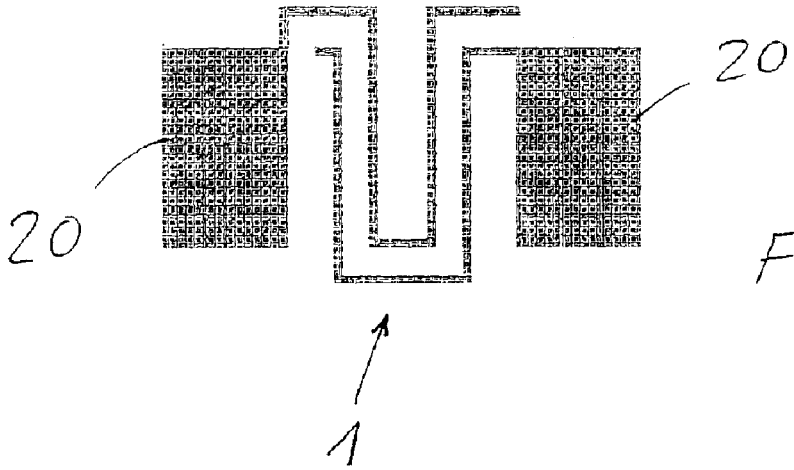
FIG. 6 shows a coupling element according to the present invention having a meander-type structure.

FIG. 6 shows a coupling element according to the present invention having a meander type structure 1 and pads 20.

Figure 7:
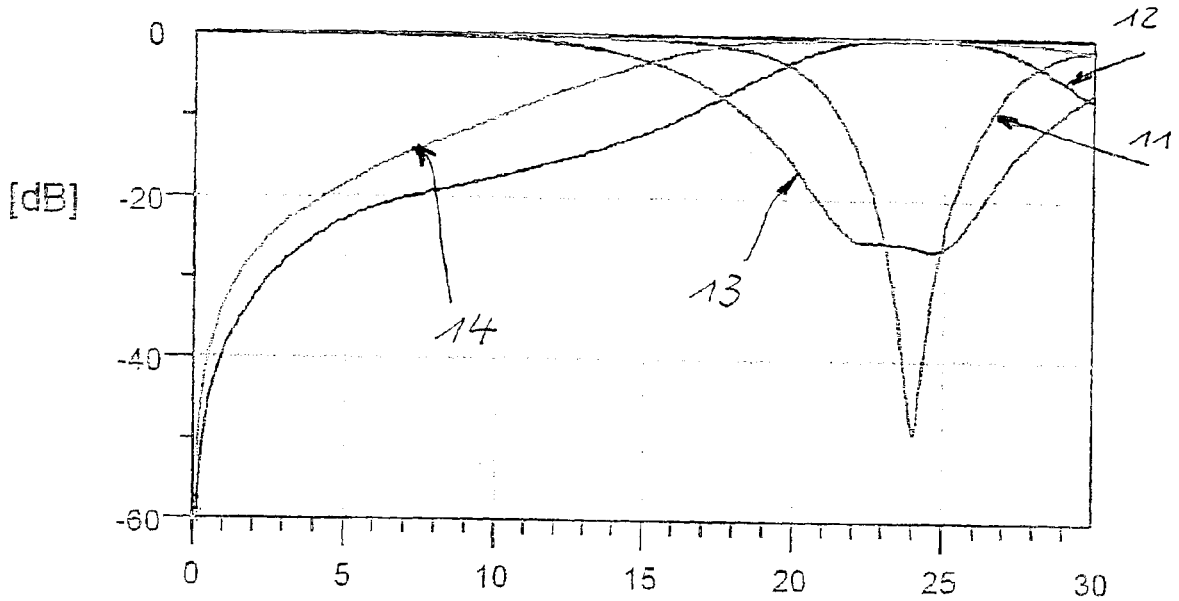
FIGS. 7 and 8 show the frequency response of coupling elements according to the related art and according to the present invention.
Figure 8:
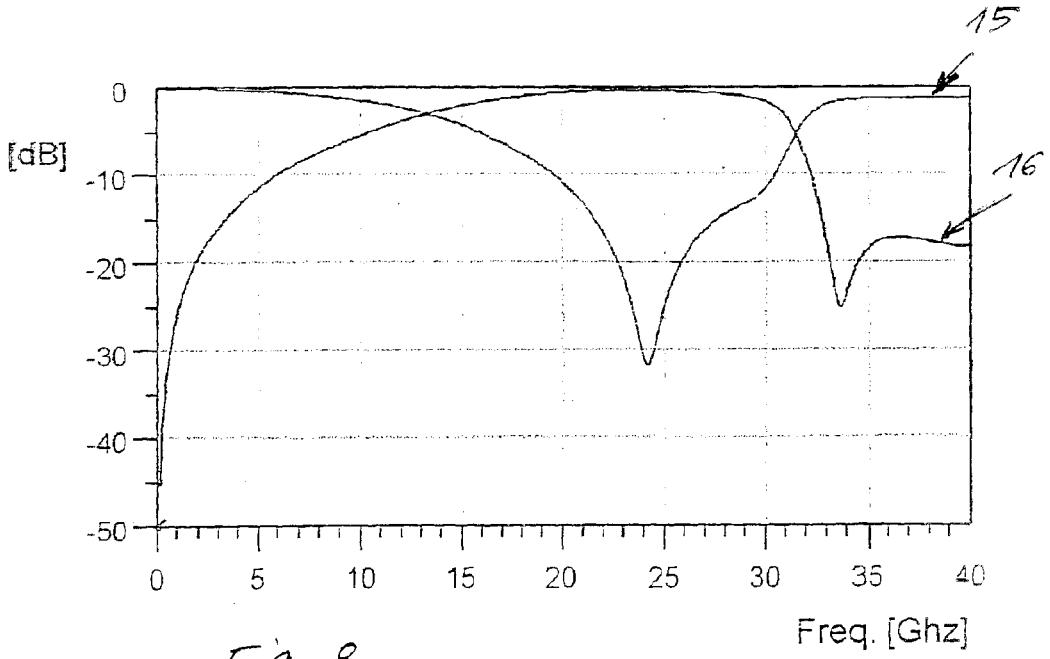

FIGS. 7 and 8 show the frequency response (frequency in GHz over attenuation in dB) of the coupling element in a conventional implementation and also in the implementation according to the present invention. Parameter S11, labeled with reference number 11, and Parameter S12, labeled with reference number 12, of the structure according to FIG. 2 are illustrated in FIG. 7. Parameter S11, labeled with reference number 13, and parameter S12, labeled with reference number 14, of the structure according to FIG. 1 are also illustrated in FIG. 7.

Parameter S11, labeled with reference number 15, and parameter S12, labeled with reference number 16, of the structure according to the present invention according to FIG. 5 are shown in FIG. 8. The improved bandpass characteristic, i.e., the greater bandwidth in the transmission range of the structure according to the present invention, is obvious.

What is claimed is:

1. A method of using a capacitive coupling element, the capacitive coupling element including a silicon support, and a finger coupler structure that includes a thin-line structure on the silicon support and is bonded to strip line tracks of a HF strip line structure via metallizations, the method comprising:

using the capacitive coupling element as a bandpass element for a high-frequency signal with simultaneous blockage of direct and low-frequency components.

2. The method as recited in claim 1, wherein:

the capacitive coupling element is used in a radar application.

3. The method as recited in claim 1, further comprising:

configuring a dielectric property of the silicon support.

4. The method as recited in claim 1, further comprising:

configuring a predefined air gap between the silicon support and an HF substrate when the silicon support is applied to the strip line tracks.

5. A coupling element for an HF strip line structure on an HF substrate, comprising:

a silicon support; and a finger coupler structure that includes a thin-layer structure on the silicon support and is bonded to strip line tracks of the HF strip line structure via metallizations.

6. The coupling element as recited in claim 5, further comprising:

planar pads arranged within the thin-layer structure and for bonding the finger coupler structure to the metallizations.

7. The coupling element as recited in claim 5, wherein:

the thin-layer structure has a design that is compatible with pick and place technologies.

8. The coupling element as recited in claim 5, wherein:

the finger coupler structure includes a meander-shaped design.

9. The coupling element as recited in claim 5, wherein:

the metallizations include spacers that provide a predefined air gap between the silicon support and the HF substrate.

10. The coupling element as recited in claim 5, wherein:

the metallizations include spacers that provide a predefined air gap between the silicon support and the HF substrate when the silicon support is applied to the strip line tracks.

* * * * *